US007159963B2

(12) United States Patent
Nishino

(10) Patent No.: US 7,159,963 B2
(45) Date of Patent: Jan. 9, 2007

(54) IMAGE RECORDING APPARATUS WITH WIPE UNIT AND NOZZLE MAINTENANCE UNIT

(75) Inventor: Satoshi Nishino, Hachioji (JP)

(73) Assignee: Konica Minolta Medical & Graphic, Inc. (JP)

( * ) Notice: Subject to any disclaimer, the term of this patent is extended or adjusted under 35 U.S.C. 154(b) by 293 days.

(21) Appl. No.: 10/826,951

(22) Filed: Apr. 15, 2004

(65) Prior Publication Data

US 2004/0223029 A1 Nov. 11, 2004

(30) Foreign Application Priority Data

Apr. 24, 2003 (JP) ..... 2003-120056
Apr. 24, 2003 (JP) ..... 2003-120067

(51) Int. Cl.
*B41J 2/165* (2006.01)

(52) U.S. Cl. ..... 347/33; 347/31

(58) Field of Classification Search ..... 347/33, 347/31

See application file for complete search history.

(56) References Cited

U.S. PATENT DOCUMENTS 5,501,149 A * 3/1996 Schleinz et al. ..... 101/416.1
5,517,222 A * 5/1996 Sugiyama et al. ..... 347/35
6,183,060 B1 2/2001 Tokuda
6,206,498 B1 3/2001 Kondo et al.
6,350,012 B1 2/2002 Sarkissian et al.
6,382,767 B1 5/2002 Greive
7,083,252 B1 * 8/2006 Yokoyama et al. ..... 347/23
2002/0171725 A1 * 11/2002 Ouchi et al. ..... 347/100
2003/0063172 A1 * 4/2003 Ohtsu et al. ..... 347/102
2003/0218652 A1 * 11/2003 Nakashima ..... 347/31
2004/0011247 A1 * 1/2004 Taguchi ..... 106/31.27

OTHER PUBLICATIONS

European Search Report for a EU application 04009561.4, mailed Jul. 18, 2005, 4 pgs.

* cited by examiner

*Primary Examiner*—Stephen Meier
*Assistant Examiner*—Rene Garcia, Jr.
(74) *Attorney, Agent, or Firm*—Squire, Sanders & Dempsey L.L.P.

(57) ABSTRACT

An image recording apparatus is disclosed having a recording head including a plurality of nozzles for jetting an ink and a maintenance unit for performing a maintenance operation to the nozzles. The maintenance unit includes an absorbing member to wipe an ink adhered to the nozzles and receive an ink residue purged from the nozzles during the maintenance operation.

19 Claims, 6 Drawing Sheets

IMAGE RECORDING APPARATUS WITH WIPE UNIT AND NOZZLE MAINTENANCE UNIT

BACKGROUND OF THE INVENTION

1. Field of the Invention

The present invention relates to an image recording apparatus and, more particularly, to an image recording apparatus to perform image recording by an ink jet system.

2. Description of the Related Art

As an image recording method for record images easily and at low cost, many types of image recording apparatuses using an ink jet system have been used. The image recording apparatus using ink jet system is such that ink is jetted from nozzles of a recording head as fine ink droplets toward a recording medium such as a paper or the like with, for example, a piezoelectric element such as a piezo element or a heater, and the recording head is moved over the recording medium while making the ink penetrate into or fix onto the recording medium to thereby record images on the recording medium.

Recently, as a method for forming images even onto a recording medium with poor ink absorptivity such as resin film, an image recording apparatus which uses ultraviolet curable ink has been known (refer to for example, JP-Tokukai-2001-310454A), in which ultraviolet curable ink comprising photo initiator with a predetermined sensitivity to ultraviolet rays is used, and the ink placed on the recording medium is cured by irradiation with ultraviolet rays to be fixed thereto. This method allows images to be easily recorded even onto transparent or nontransparent packing material.

However, in the image recording apparatus of the ink jet system, the ink jetted from the nozzles of the recording head is turned into spray to disperse, causing the ink to adhere to a portion outside the recording medium. For example, in the case that the ink dispersed is adhered to a portion near the nozzles, the ink would stack in the nozzle to cause clogging, thereby raising a problem for image recording.

The ink dispersed from the nozzles may adhere to a platen as well as the portion near the nozzles. Specially, in the case of using cationic polymerizable ultraviolet curable ink or the like whose main component is a monomer, the monomer has a property to make resin such as plastic melt. Therefore, a platen made of plastic is melted at a portion to which the ink is attached, causing irregularity on the surface thereof, thereby raising a problem that the recording medium may not be carried smoothly for image recording. A platen made of metal such as aluminum would not be damaged by the melt on the surface, however, because the ultraviolet ray curable ink is cured by irradiation with light, the ink adhered to the platen may be cured, thereby causing irregularity on the surface of the platen. Therefore, the same problem is raised so that the recording medium is inhibited from being carried.

The ink which turned into spray may adhere to a portion of a maintenance unit. For example, when the ink adheres to a suction cap provided on the maintenance unit, the ink is cured on the suction cap by irradiation with light. It would inhibit a contact between the nozzle face of the recording head and the suction cap for maintenance of the recording head, resulting in failing to perform an appropriate maintenance of the nozzles.

Accordingly, for performing stable and high definition image recording, the ink which turned into spray to be dispersed on each part of the nozzles of the recording head, the platen, and the maintenance unit should be appropriately removed to keep an appropriate condition for image recording.

For removing the ink adhered to a portion around the nozzles of the recording head, there is known to provide a space for purging ink residue within a recording head movable region. The maintenance is performed by purging ink residue to the provided space every time a certain amount of image recording is completed (for example, see, JP-2675887B).

However, providing a specific space for purging ink residue would cause the need to make the apparatus be large by the size of the space. Since the ink residue purged into the space needs to be fed to a waste ink tank, a mechanism for suctioning and feeding the ink jetted to the space is required. However, providing such a mechanism would make the apparatus be large and complicated, thereby raising a problem to increase the cost for manufacturing the apparatus.

Specially, use of ink with high viscosity such as cationic polymerizable ultraviolet curable ink for performing image recording would cause a problem that the ink is difficult to be fed to the waste ink tank. For example, the ink with high viscosity easily adheres to the waste ink path when feeding the ink, and further the ink suctioned would clog in the waste ink path, thereby failing to perform the suction operation. Therefore, for smoothly feeding ink to the waste ink tank, a special member needs to be provided for raising a suction pressure to suction ink residue purged, resulting in a problem that the apparatus becomes large and the cost for manufacturing the apparatus is increased.

Appropriate maintenance operations for portions of the platen or the suction cap are also required, however, in the related art, the maintenance operations have not been performed for these portions. Thus, the apparatus could not be kept in a proper condition by appropriately removing ink which turned into spray for performing image recording, thereby raising a problem that it is difficult to stably perform high definition image recording.

SUMMARY OF THE INVENTION

The present invention is developed in view of the above described points, and an object of the present invention is to provide an image recording apparatus which can properly perform a maintenance operation to each portion of a recording head, a platen, a maintenance unit and the like and perform high definition image recording without making the apparatus be large and complicated.

In order to attain the above described object, in accordance with a first aspect of the present invention, an image recording apparatus comprises:

a recording head comprising a plurality of nozzles for jetting an ink; and a maintenance unit for performing an maintenance operation to the nozzles, the maintenance unit comprising an absorbing member to wipe an ink adhered to the nozzles and receive an ink residue purged from the nozzles during the maintenance operation.

Accordingly, since the maintenance unit comprises the absorbing member, the ink adhered to the nozzle face can be wiped out and appropriately removed. Since ink residue is purged onto the absorbing member to wipe ink, an additional space for purging ink residue is not required, and there is no need to feed ink residue purged to a waste ink tank or the like. Thus, a save-spacing and a cost-saving can be realized.

Preferably, in the apparatus of the first aspect of the present invention, the maintenance unit comprises a drive mechanism for moving an ink absorbed portion of the absorbing member to a new position after the absorbing member absorbed the ink.

Accordingly, since the image recording apparatus comprises the mechanism for moving the ink absorbed portion after the absorbing member absorbed ink, ink absorption is not performed by the ink absorbed portion of the absorbing member again, thereby preventing the ink absorbed in absorbing member from readhering to some other portions. Therefore, the ink adhered to a portion other than the recording medium can appropriately be removed, enabling the image recording apparatus to always keep condition for performing high definition image recording.

Preferably, in the apparatus of the first aspect of the present invention, each of the inks is a type of being cured by an irradiation with light, and the maintenance unit comprises a light irradiation device for irradiating the ink absorbed in the absorbing member with light.

Accordingly, since the ink is cured by irradiating the ink adhered portion of the absorbing member with light after the absorbing member absorbed the ink, it can be prevented that the ink absorbed in absorbing member readhere to some other portions. Thus, exchange of the absorbing member or the like can be easily performed.

Preferably, in the apparatus of the first aspect of the present invention, the light irradiation device irradiates a small amount of light of 1 $mJ/cm^2$ to 30 $mJ/cm^2$.

Accordingly, since the light irradiation device irradiates a small amount of light, only the ink adhered to the absorbing member can be properly cured.

Preferably, in the apparatus of the first aspect of the present invention, the absorbing member is formed with a high density fiber having a fineness of 0.1 denier or less.

Accordingly, since the absorbing member is formed with high density fibers, when wiping the ink adhered to the nozzles or purging ink residue from the nozzles, the ink can be easily and immediately absorbed by the capillary action or the like, thereby the ink is removed from the nozzle faces.

Preferably, in the apparatus of the first aspect of the present invention, the ink has a viscosity of 10 to 500 mPa·s at 25° C. and a surface tension of 20 to 40 mN/m.

Accordingly, for example even in the case of using the ink with high viscosity such as ultraviolet curable ink having high viscosity and low wetting property, the maintenance operation of purging ink residue can be performed smoothly and easily.

Preferably, in the apparatus of the first aspect of the present invention, the ink comprises an active energy ray curable compound, and an active energy ray comprises an ultraviolet ray.

Accordingly, the maintenance operation can properly be performed even in the case of using the ink which is cured by irradiation with ultraviolet rays for image recording. When ultraviolet curable ink is used for image recording, the ink is cured by irradiation with ultraviolet rays after jetting the ink, so that the quality of recorded images can be maintained over a prolonged period.

Moreover, use of ultraviolet curable ink for image recording is successful in performing high definition image recording onto a recording medium with low ink absorptivity such as resin film or a recording medium with no ink absorptivity as well as the recording medium with high ink absorptivity such as paper.

In accordance with a second aspect of the present invention, an image recording apparatus comprises:

a recording head comprising a plurality of nozzles for jetting an ink onto a recording medium; and a wipe unit provided on at least one of an upstream side and a downstream side of the recording head in a moving direction, the wipe unit comprising an absorbing member for absorbing an ink which was jetted and adhered to a portion other than the recording medium.

According to this configuration, the ink adhered to a portion other than the recording medium can be appropriately suctioned and removed, so that it can be prevented that the ink adhered to the portion other than the recording medium readhere to the recording medium or the like, and there is less possibility that the maintenance operation is inhibited by the ink adhered. Thus, it can be realized to always perform high definition image recording.

Preferably, in the apparatus of the second aspect of the present invention, the apparatus further comprises a platen for supporting the recording medium, wherein the absorbing member absorbs an ink adhered to the platen.

According to this configuration, the ink adhered to the platen can be properly suctioned and removed, so that irregularity is not generated on the surface of the platen by the ink adhered thereto, enabling to perform the carrying operation of the recording medium without being inhibited by the ink. Thus, it can be realized to always perform image recording stably.

Preferably, in the apparatus having the platen of the second aspect of the present invention, the wipe unit comprises a drive mechanism for moving an ink absorbed portion of the absorbing member to a new position after the absorbing member absorbed the ink.

Accordingly, since the image recording apparatus comprises the mechanism for moving the ink absorbed portion after the absorbing member absorbed ink, ink absorption is not performed by the ink absorbed portion of the absorbing member again, thereby preventing the ink absorbed n absorbing member from readhering to some other portions. Therefore, the ink adhered to a portion other than the recording medium can appropriately be removed, enabling the image recording apparatus to always keep a condition for performing high definition image recording.

Preferably, in the apparatus having the platen of the second aspect of the present invention, the ink is a type of being cured by an irradiation with light, and the wipe unit comprises a light irradiation device for irradiating the ink absorbed in the absorbing member with light.

Accordingly, since the ink is cured by irradiating the ink adhered portion of the absorbing member with light after the absorbing member absorbed the ink, it can be prevented that the ink absorbed in absorbing member readhere to some other portions. Thus, exchange of the absorbing member or the like can be easily performed.

Preferably, in the apparatus having the platen of the second aspect of the present invention, the absorbing member is formed with a high density fiber having a fineness of 0.1 denier or less.

Accordingly, since the absorbing member is formed with high density fibers, when wiping the ink adhered to the platen, the ink can be easily and immediately absorbed by the capillary action or the like, thereby the ink is properly removed.

Preferably, in the apparatus having the platen of the second aspect of the present invention, the ink has a viscosity of 10 to 500 mPa·s at 25° C. and a surface tension of 20 to 40 mN/m.

Accordingly, for example even in the case of using the ink with high viscosity such as ultraviolet curable ink having high viscosity and low wetting property, the maintenance operation to wipe the ink adhered to the platen can be performed smoothly and easily.

Preferably, in the apparatus having the platen of the second aspect of the present invention, the ink comprises an active energy ray curable compound, and an active energy ray comprises an ultraviolet ray.

Accordingly, the maintenance operation can properly be performed even in the case of using the ink which is cured by irradiation with ultraviolet rays for image recording. When ultraviolet curable ink is used for image recording, the ink is cured by irradiation with ultraviolet rays after jetting the ink, so that the quality of recorded images can be maintained over a prolonged period.

Moreover, use of ultraviolet curable ink for image recording is successful in performing high definition image recording onto a recording medium with low ink absorptivity such as resin film or a recording medium with no ink absorptivity as well as the recording medium with high ink absorptivity such as paper.

Preferably, in the apparatus of the second aspect of the present invention, the apparatus further comprises a suction cap in a movable range of the recording head for performing a maintenance of the nozzles by suctioning an ink in the nozzles of the recording head, wherein the absorbing member absorbs an ink adhered to the suction cap.

According to this configuration, since inhibition of contact between the nozzle face of the recording head and the suction cap, which is caused by fixation of the ink adhered to the suction cap, is not caused in the maintenance operation, enabling to always perform a proper maintenance operation. Thus, it can be realized to always form high quality images even when performing image recording continuously.

Preferably, in the apparatus having the suction cap of the second aspect of the present invention, the wipe unit comprises a drive mechanism for moving an ink absorbed portion of the absorbing member to a new position after the absorbing member absorbed the ink.

Accordingly, since the image recording apparatus comprises the mechanism for moving the ink absorbed portion after the absorbing member absorbed ink, ink absorption is not performed by the ink absorbed portion of the absorbing member again, thereby preventing the ink absorbed in absorbing member from readhering to some other portions. Therefore, the ink adhered to a portion other than the recording medium can appropriately be removed, enabling the image recording apparatus to always keep a condition for performing high definition image recording.

Preferably, in the apparatus having the suction cap of the second aspect of the present invention, each of the inks is a type of being cured by an irradiation with light, and the wipe unit comprises a light irradiation device for irradiating the ink absorbed in the absorbing member with light.

Accordingly, since the ink is cured by irradiating the ink adhered portion of the absorbing member with light after the absorbing member absorbed the ink, it can be prevented that the ink absorbed in absorbing member readhere to some other portions. Thus, exchange of the absorbing member or the like can be easily performed.

Preferably, in the apparatus having the suction cap of the second aspect of the present invention, the absorbing member is formed with a high density fiber having a fineness of 0.1 denier or less.

Accordingly, since the absorbing member is formed with high density fibers, when wiping the ink adhered to the suction cap, the ink can be easily and immediately absorbed by the capillary action or the like, thereby the ink is properly removed.

Preferably, in the apparatus having the suction cap of the second aspect of the present invention, the ink has a viscosity of 10 to 500 mPa·s at 25° C. and a surface tension of 20 to 40 mN/m.

Accordingly, for example even in the case of using the ink with high viscosity such as ultraviolet curable ink having high viscosity and low wetting property, the maintenance operation to wipe the ink adhered to the suction cap can be performed smoothly and easily.

Preferably, in the apparatus having the suction cap of the second aspect of the present invention, the ink comprises an active energy ray curable compound, and an active energy ray comprises an ultraviolet ray.

Accordingly, the maintenance operation can properly be performed even in the case of using the ink which is cured by irradiation with ultraviolet rays for image recording. When ultraviolet curable ink is used for image recording, the ink is cured by irradiation with ultraviolet rays after jetting the ink, so that the quality of recorded images can be maintained over a prolonged period.

Moreover, use of ultraviolet curable ink for image recording is successful in performing high definition image recording onto a recording medium with low ink absorptivity such as resin film or a recording medium with no ink absorptivity as well as the recording medium with high ink absorptivity such as paper.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Hereinafter, the preferred embodiments of the present invention will be described in detail by reference to FIGS. 1 to 6.

Figure 1:
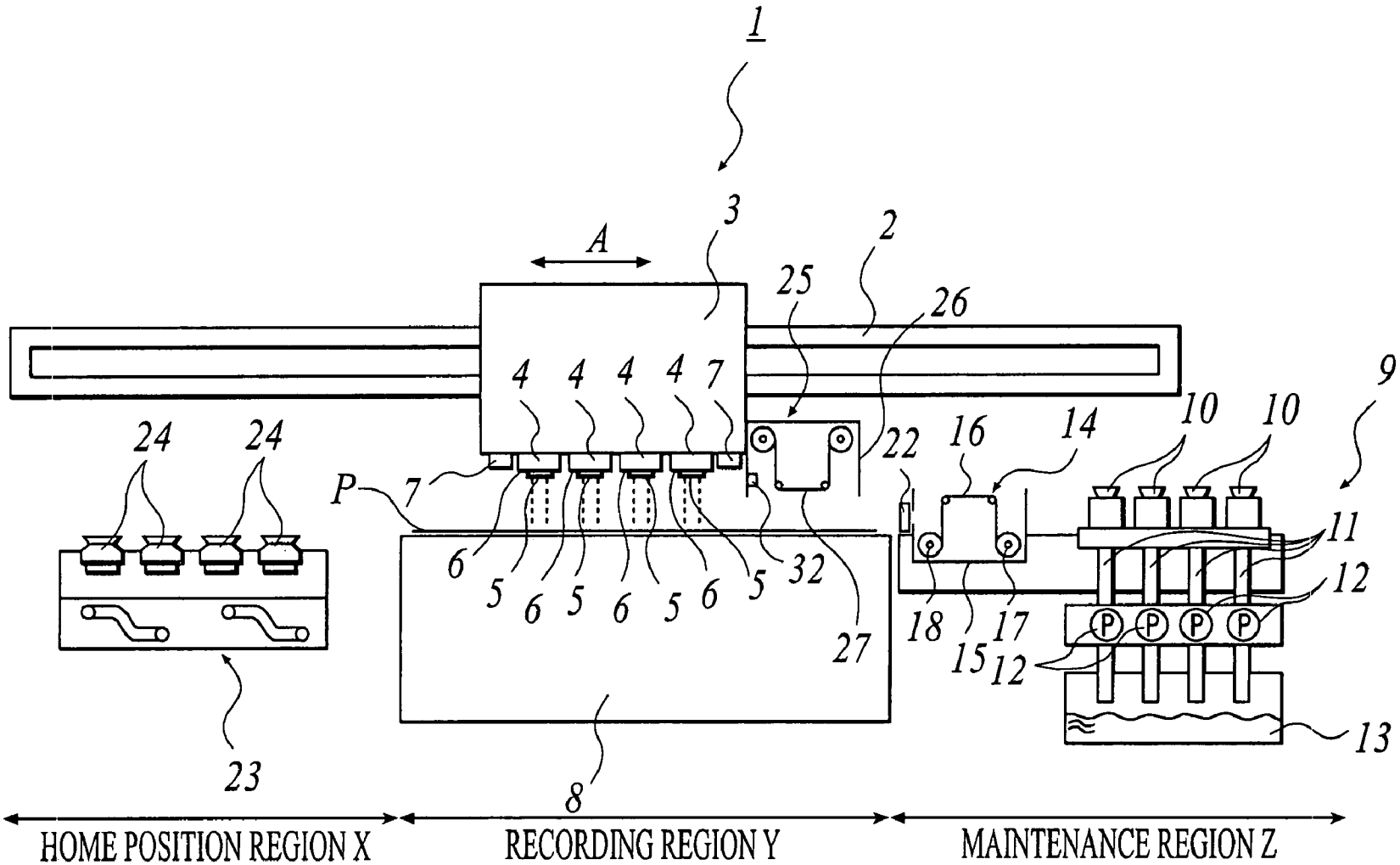
FIG. 1 is a schematic front view showing an image recording apparatus of the embodiment.

As shown in FIG. 1, in this embodiment, an image recording apparatus 1 is a serial print type, comprising a bar shaped carriage rail 2 which extends in a main scanning direction A. On the carriage rail 2, a carriage 3 is reciprocably supported along the carriage rail 2, and is adapted to reciprocate in the main scanning direction A by a carriage drive mechanism 33 (refer to FIG. 6).

The carriage 3 is provided with recording heads 4, 4 . . . each of which is formed with nozzles 5, 5 . . . for jetting ink as shown in FIG. 1. The recording heads 4, 4 . . . are for jetting each color of inks of, for example, yellow (Y), magenta (M), cyan (C) and black (B) which corresponds with the color used in this embodiment from the nozzles 5, 5 . . . onto a recording medium P.

An ultraviolet ray (UV) irradiation device 7 is provided on each side on the carriage 3 to be adjacent to the recording heads 4, 4 . . . , for irradiating the ink jetted from the nozzles 5, 5 . . . with ultraviolet rays.

A recording region Y is for performing recording onto the recording medium P, which is approximately in a middle portion of a carriage 3 movable range. In the recording region Y, there is provided a platen 8 for supporting a non-recording surface of the recording medium P while the recording operation. The platen 8 extends in the main scanning direction A to have a length slightly longer than a width of the recording medium P. The recording medium P is carried in a sub scanning direction which is perpendicular to the main scanning direction A by a recording medium carrying mechanism 34 (refer to FIG. 6) on the platen 8 while the image recording.

A maintenance region Z is for performing maintenance of nozzle faces 6, 6 . . . on which the nozzles 5, 5 . . . of the recording heads 4, 4 . . . are formed. The maintenance region Z is provided on one side of the recording region Y within the carriage 3 movable range.

A maintenance unit 9 is provided in the maintenance region Z. As shown in FIG. 1, the maintenance unit 9 comprises suction caps 10, 10 . . . as a cap member as many as the recording heads 4, 4 . . . , each of which is positioned to correspond to one of the recording heads 4, 4 . . . to cover the nozzle face 6 when the carriage 3 was moved to the maintenance region Z.

An ink communicating tube 11 is provided at the bottom surface of each of the suction caps 10, 10 . . . to communicate with the inside thereof. Each of the ink communicating tubes 11, 11 . . . is provided with a suction pump 12 in a middle portion thereof, and a waste ink tank 13 is disposed at a low end of the ink communicating tubes 11, 11 . . . for receiving the ink suctioned.

There is provided an ink absorbing mechanism 14 near one end of the suction caps 10, 10 . . . , which is for wiping the ink adhered to the nozzles 5, 5 . . . of the recording heads 4, 4 . . . and for purging ink residue from the nozzles 5, 5 . . . .

Figure 2:
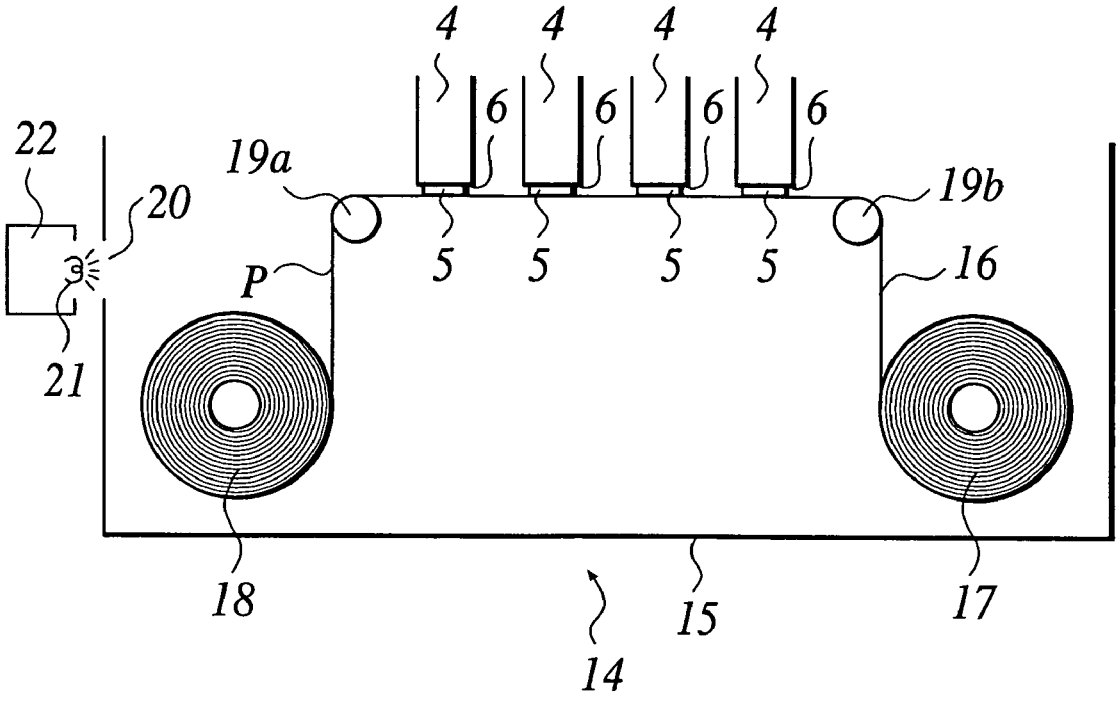
FIG. 2 is a schematic front view showing an ink absorbing mechanism of the image recording apparatus of the embodiment.

As shown in FIG. 2, the ink absorbing mechanism 14 comprises a box shaped case member 15 having an opening on a side facing the recording heads 4, 4 . . . when the carriage was moved to the maintenance region Z. A feed roller 17 is rotatably provided on one side of the inside of the case member 15, and a sheet shaped long absorbing member 16 is rolled thereon. A winding roller 18 is rotatably provided on the other side of the inside of the case member 15 for winding the absorbing member 16. At the upper portion of the case member 15, there are provided guide rollers 19*a*, 19*b* for guiding the absorbing member 16 fed from the feed roller 17 while giving a constant tension thereto above the feed roller 17 and the winding roller 18, respectively. The feed roller 17 and the winding roller 18 are rotatably driven by a roller drive mechanism 37 (refer to FIG. 6). The feed roller 17 and the winding roller 18 are rotated to carry the absorbing member 16 guided by the guide rollers 19*a*, 19*b* while keeping a constant height, and the absorbing member 16 is wound by the winding roller 18.

The absorbing member 16 has fineness of 0.1 denier or less, and is formed with high density fibers having extra fine thickness of approximately 1 to 5 μm. Examples of the high density fibers applicable include synthetic fibers such as polyester, acryl and nylon. Use of the absorbing member 16 comprising extra fine fibers having fineness of 0.05 to 0.2 denier, and preferably 0.1 denier or less is successful in immediately absorbing the ink adhered to the nozzles 5, 5 . . . of the recording heads 4, 4 . . . regardless of viscosity of the ink by the capillary action or the like. According to the absorbing member 16 in this embodiment, specially, even when performing image recording by using the UV curable ink having high viscosity in comparison with water-based or oil-based ink, the ink adhered to the nozzles 5, 5 . . . can be certainly and promptly suctioned and removed.

The case member 15 is provided with an opening 20 extending in a width direction of the absorbing member 16 in one surface thereof, that is on the side on which the winding roller 18 is disposed. An ultraviolet ray (UV) irradiation section 22 having an ultraviolet ray (UV) light source 21 for irradiating the absorbing member 16 with a small amount of ultraviolet rays is provided adjacent to the opening 20 of the ink absorbing mechanism 14. The UV light source 21 is, for example, an LED, high pressure mercury lamp, hot cathode ray tube or the like, which is capable of irradiating a small amount of ultraviolet rays of at least 1 $mJ/cm^2$ to 30 $mJ/cm^2$. Ultraviolet rays may be directly radiated from the UV light source 21, or may be emitted from a UV emitting device (not shown) and guided by optical fibers to be indirectly radiated.

Figure 3:
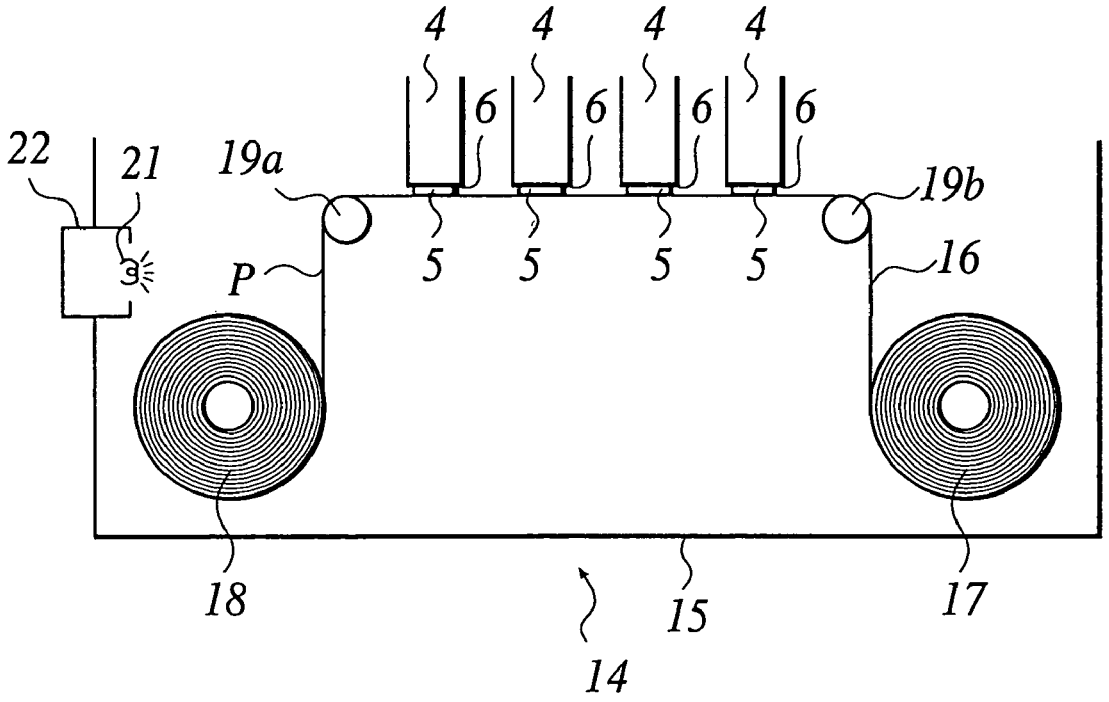
FIG. 3 is a schematic front view showing a modified example of the ink absorbing mechanism of the image recording apparatus of the embodiment.
Figure 4:
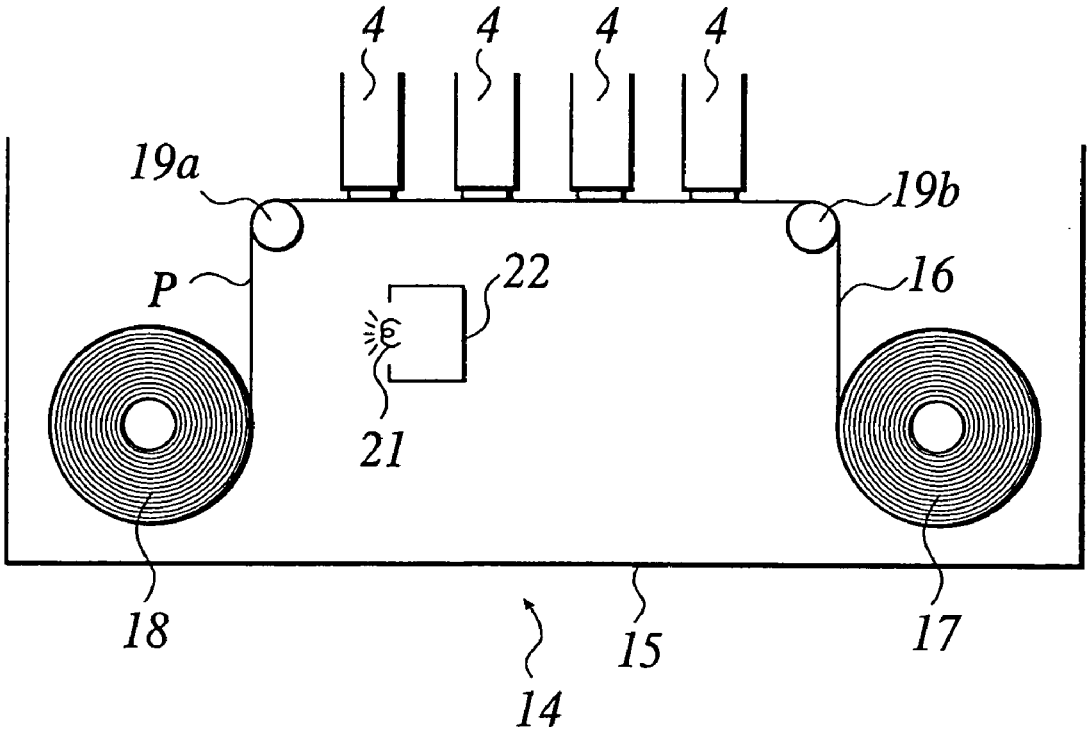
FIG. 4 is a schematic front view showing another modified example of the ink absorbing mechanism of the image recording apparatus of the embodiment.

The position to provide the UV irradiation section 22 for irradiating the absorbing member 16 of the ink absorbing mechanism 14 with ultraviolet rays is not limited to that in this embodiment. For example, as shown in FIG. 3, the UV irradiation section 22 may be integrated with one side of the case member 15 which is the side where the winding roller 18 is provided. As shown in FIG. 4, the UV irradiation section 22 may be provided under the absorbing member 16 in the ink absorbing mechanism 14, to face the absorbing member 16 between the winding roller 18 and the guide roller 19*a* positioned above the winding roller 18, thereby irradiating the side of the absorbing member 16 opposite to the ink absorbing side.

Figure 5:
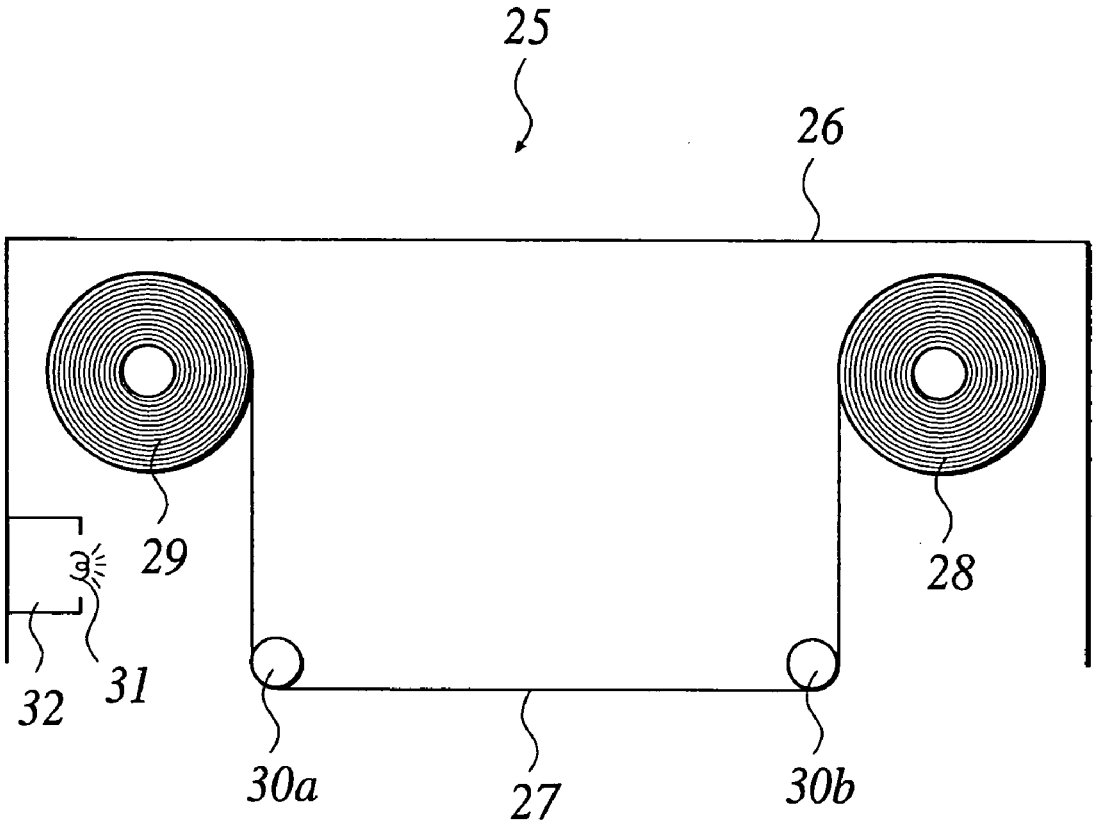
FIG. 5 is a schematic front view showing a wipe unit of the image recording apparatus of the embodiment.

A wipe unit 25 is provided on one side of the carriage 3 of the maintenance region Z side, which is for absorbing the ink adhered to the surface of the platen 8 and the suction caps 10, 10 . . . to remove them. As shown in FIG. 5, the wipe unit 25 can move up and down along a guide rail (not shown) provided on a side of the carriage 3. Thus, while image recording operation, the wipe unit 25 can move upward to the position where the wipe unit 25 does not contact with the recording medium P. This configuration is not limited to that of this embodiment, for example, the wipe unit 25 may be fixed at one end of the upper surface thereof to the side of the carriage 3, and the wipe unit 25 may be rotatable around the fixed end as a fulcrum upwardly with respect to the carriage 3 by a drive source which is not shown.

As shown in FIG. 5, the wipe unit 25 has a configuration similar to that of the ink absorbing mechanism 14, that is, the wipe unit 25 comprises a boxed shaped case member 26 having an opening in one surface facing the platen 8. A feed roller 28 is provided on one side of the upper portion inside of the case member 26, on which a sheet shaped long absorbing member 27 is wound. The absorbing member 27 has a width approximately equal to the length of the platen 8 in the carrying direction of the recording medium P. A winding roller 29 is rotatably provided on the other side of the upper portion inside of the case member 26, which is for winding the absorbing member 27. At the lower portion of the case member 26, rotatable guide rollers 30*a*, 30*b* are provided for guiding the absorbing member 27 fed from the feed roller 28 while giving a constant tension thereto under the feed roller 28 and the winding roller 29, respectively. The feed roller 28 and the winding roller 29 are rotatably driven by the roller drive mechanism 38 (refer to FIG. 6). With the rotation of the feed roller 28 and the winding roller 29, the absorbing member 27 is carried to be guided by the guide rollers 30*a*, 30*b* while keeping a constant height slightly higher than the height of the case member 26, and then wound by the winding roller 18.

The absorbing member 27, which is similar to the absorbing member 16 provided in the ink absorbing mechanism 14, has fineness of 0.1 denier or less, and is formed with high density fibers having an extra fine thickness of approximately 1 to 5 μm. Use of the absorbing member 27 comprising extra fine fibers with fineness of 0.05 to 0.2 denier, preferably 0.1 denier or less is successful in immediately absorbing the ink adhered to the platen 8 or the suction caps 10, 10 . . . regardless of viscosity of the ink by the capillary action or the like. According to the absorbing member 27 in this embodiment, specially, even when performing image recording by using the UV curable ink having high viscosity in comparison with water-based or oil-based ink, the ink adhered to the platen 8 or the suction caps 10, 10 . . . can be certainly and promptly suctioned to be removed.

The case member 26 is provided with an ultraviolet ray (UV) irradiation section 32 having an ultraviolet ray (UV) light source 31 for irradiating the absorbing member 27 with ultraviolet rays on one surface inside thereof, or the side on which the winding roller 29 is provided. The UV irradiation section 32 is disposed to face the absorbing member 27 tensioned between the winding roller 29 and the guide roller 30*a* positioned below the winding roller 29. The UV light source 31 is, for example, an LED, high pressure mercury lamp, hot cathode ray tube or the like, which is capable of radiating a small amount of ultraviolet rays of at least 1 $mJ/cm^2$ to 30 $mJ/cm^2$. Ultraviolet rays may be directly radiated from the UV light source 31, or may be emitted from a UV emitting device (not shown) and guided by optical fibers to be indirectly radiated.

The position to provide the UV irradiation section 32 for irradiating the absorbing member 27 of the wipe unit 25 with ultraviolet rays is not limited to that in this embodiment. For example, there may be provided an opening extending in a width direction of the absorbing member 27 in a surface of the wipe unit 25, that is on the side on which the winding roller 29 is disposed, and the UV irradiation section 32 may be arranged adjacent to the opening of the wipe unit 25. Further, with the opening provided in one surface of the wipe unit 25, a light reflection member (not shown) may be provided on the UV irradiation device 7 which is mounted on the carriage 3. In this case, when the wipe unit 25 performs the ink absorbing and removing operations, the UV irradiation device 7 emits ultraviolet rays, that pass through the opening to be radiated to the absorbing member 27 in the wipe unit 25. Furthermore, the UV irradiation section 32 may be provided upside of the absorbing member 27 in the wipe unit 25 to face the absorbing member 27 tensioned between the winding roller 29 and the guide roller 30*a* below the winding roller 29. In this case, the absorbing member 27 is irradiated with ultraviolet rays from the opposite side of the ink absorption side.

A home position region X is provided on a side opposite to the recording region Y across the maintenance region Z, the home position region X is for keeping the recording heads 4, 4 . . . on standby except the time of image recording and the maintenance operation. In the home position region X, there is provided a light shielding unit 23 comprising light shielding caps 24, 24 . . . as many as the recording heads 4, 4 . . . , for protecting the nozzle faces 6, 6 . . . of the recording heads 4, 4 . . . from light, especially, ultraviolet rays when image recording is not performed.

A configuration of control according to this embodiment will be explained referring to FIG. 6.

Figure 6:
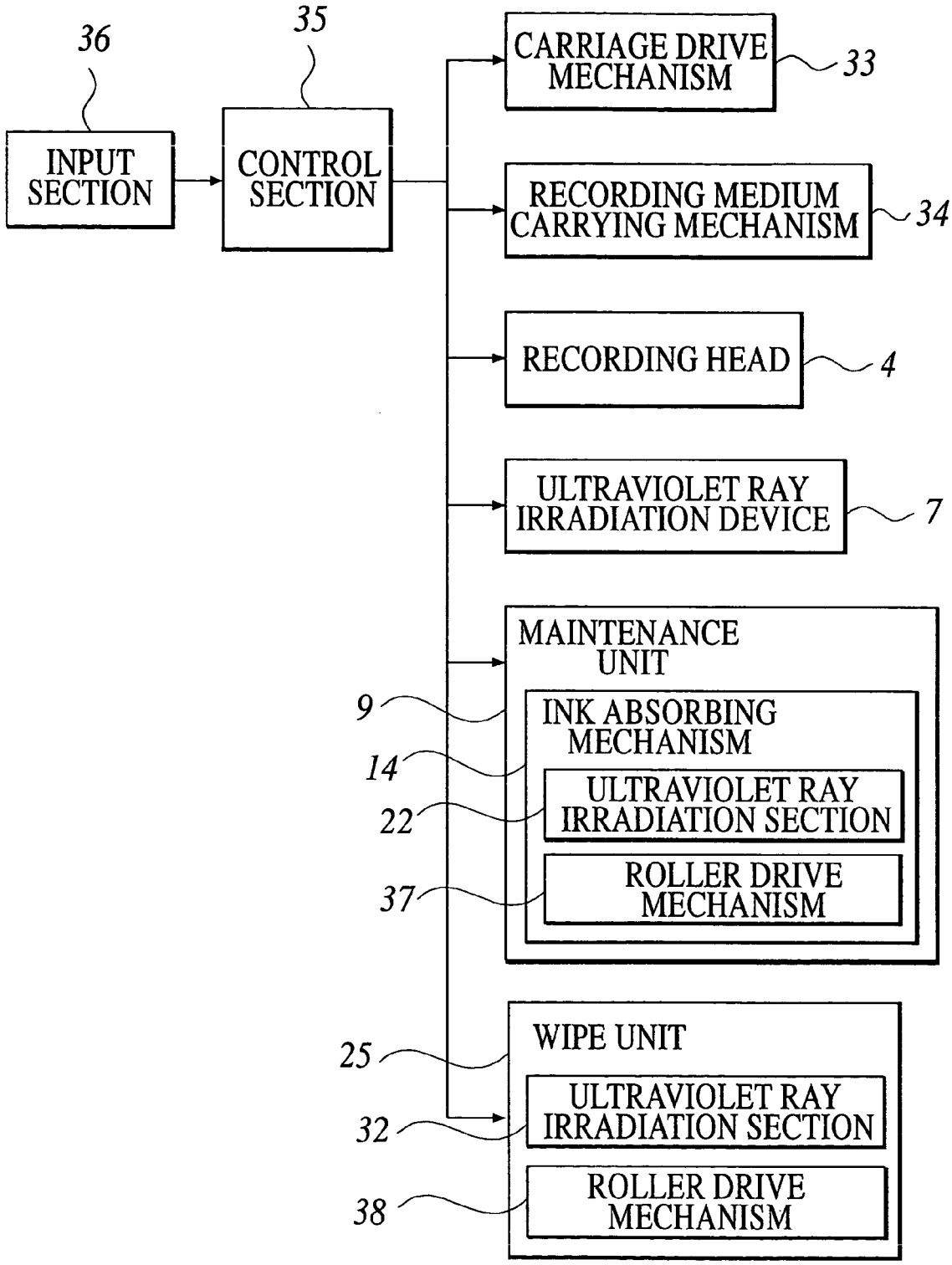
FIG. 6 is a main portion block diagram schematically showing a control device of the embodiment.

In this embodiment, as shown in FIG. 6, the image recording apparatus 1 comprises a control section 35 for controlling the carriage drive mechanism 33, the recording medium carrying mechanism 34, the recording heads 4, 4 . . . , the UV irradiation devices 7, 7 . . . , and the maintenance unit 9.

The control section 35 controls the operations of the carriage drive mechanism 33 and the recording medium carrying mechanism 34 such that the carriage 3 is reciprocated in the main scanning direction A and a carrying and a stop of the recording medium P is repeated corresponding to the operation of the carriage 3 to intermittently carry the recording medium P in the sub scanning direction.

The control section 35 also controls the UV irradiation devices 7, 7 . . . to radiate ultraviolet rays therefrom.

Further, an input section 36 for accepting input of image recording conditions or the like and the recording heads 4, 4 . . . are connected to the control section 35, enabling the control section 35 to make the recording heads 4, 4 . . . operate based on predetermined signals inputted from the input section 36, and thereby jetting the ink on the recording medium P to form predetermined images.

The control section 35 controls the maintenance unit 9 to move to a position where each recording head 4 corresponds to one of the absorption caps 10, 10 . . . of the maintenance unit 9 at the time of the maintenance operation, and also controls the suction pumps 12, 12 . . . and the like to perform ink absorption from the nozzles 5, 5 . . . of the recording heads 4, 4 . . . .

Further, the control section 35 moves the maintenance unit 9 upward to make the absorbing member 16 of the ink absorbing mechanism 14 contact with the nozzle faces 6, 6 . . . of the recording heads 4, 4 . . . , thereby wiping the nozzle faces 6, 6 . . . to remove the ink adhered thereto, and also operates the recording heads 4, 4 . . . to purge ink residue from the nozzles 5, 5 . . . to the ink absorbing mechanism 14.

The ink adhered to the absorbing member 16 by wiping the recording heads 4, 4 . . . or by purging ink residue from the nozzles 5, 5 . . . are treated such that the control section 35 controls the UV irradiation section 22 of the ink absorbing mechanism 14 to irradiate a portion of the absorbing member 16 to which the ink is adhered with a small amount of ultraviolet rays radiated from the UV light source 21. Further, the control section 35 controls the roller drive mechanism 37 to wind the absorbing member 16 to which the ink is adhered by the winding roller 18.

The control section 35 controls the wipe unit 25 to make the absorbing member 27 of the wipe unit 25 contact with the platen 8 and the suction caps 10, 10 . . . , thereby absorbing and removing the ink adhered to the platen 8 and the suction caps 10, 10 . . . .

The ink adhered to the absorbing member 27 by absorbing and removing the ink adhered to the platen 8 and the suction caps 10, 10 . . . are treated such that the control section 35 controls the UV irradiation section 32 to irradiate a portion of the absorbing member 27 to which the ink is adhered with a small amount of ultraviolet rays radiated from the UV light source 31. Further, the control section 35 controls the roller drive mechanism 38 to wind the absorbing member 27 to which the ink is adhered by the winding roller 29.

The ink used in the embodiment will be explained.

The ink applicable in this embodiment includes water-based ink, oil-based ink, active energy ray curable ink and the like, however, in view of preventing clogging of heads and easily performing maintenance, oil-based ink or active energy ray curable ink is preferably used.

Active energy ray curable ink is the ink adapted in "Curing System Utilizing Photo-Acid and Base Generating Agent (Section 1)" or "Photo-induced Alternating Copolymerization (Section 2)" of "Photo-Curing System (Chapter 4)" in "Photo-Curing Technique—Selection and Compounding Condition of Resin and Initiator, and Measurement and Assessment of Curing Degree (Technical Association Information)". This ink includes color material, polymerizable compound, initiator and the like, and has a property to cure by cross-linking and polymerization reaction of monomers by catalysis of initiator when irradiated with active energy rays. However, when the ink which is adapted to the above described "Photo-Induced Alternating Copolymerization (Section 2)" is used in the embodiment, initiator may be excluded.

Active energy ray includes, for example, ultraviolet ray, electron beam, visible ray, infrared ray, X-ray or the like, however, in view of degree of freedom for choosing initiator and polymerizable compound, ultraviolet ray is preferable.

Polymerizable compound includes radical polymerizable compound, cationic polymerizable compound and anionic polymerizable compound, each of which may be used independently or a hybrid of which may be applied as ink.

Cationic polymerizable compound in which inhibition of polymerization by oxygen less occurs is preferably used. As cationic polymerizable compound, oxetane compound, epoxide compound, vinyl ether compound or the like is preferably used independently or as a mixture. However, the ink applicable for this embodiment is not limited thereto.

The ink applicable for this embodiment is, for example, oil-based ink in which pigment is dispersed in saturated hydrocarbon medium. As examples of such saturated hydrocarbon solvent, isoparaffin solvent and cycloparaffin solvent in a single use can be adapted, that are represented by Isopar Series or Exxole Series made EXXON CHEMICAL JAPAN, LTD. In view of storing stability under low temperature or the like, the freezing point of the ink is preferably −10° C. or below.

The ink used in this embodiment has high viscosity with viscosity of 10 to 500 mPa·s at 25° C. and surface tension of 20 to 40 mN/m. It is preferable that the ink has viscosity of 10 to 500 mPa·s at 30° C., however, viscosity of 15 to 500 mPa·s is more preferable to obtain high quality images. The ink having low viscosity would blur on the recording medium to thereby deteriorate the quality of recorded images. The ink having viscosity over 500 mPa·s would fail to obtain smoothness of images. Accordingly, the optimum viscosity for obtaining stable image quality is 15 to 500 mPa·s.

Further, preferably, the ink has viscosity of 3 to 30 mPa·s at 60° C., more preferably 3 to 20 mPa·s. The ink having viscosity of 3 below mPa·s would cause problems such as a failure of precisely placing the ink when jetting the ink at high speed, and the ink having viscosity over 30 mPa·s would result in deterioration of jetting property.

Next, operations of the embodiment will be explained.

In the embodiment, the carriage 3 mounting the recording heads 4, 4 . . . are on standby above the light shielding unit 23 provided at the home position region X excluding the time of image recording and head maintenance operation. Each light shielding cap 24 provided on the light shielding unit 23 covers each nozzle face 6 of the recording heads 4, 4 . . . to protect the nozzle faces 6, 6 . . . from irradiation with light such as ultraviolet rays.

After signals for performing the recording operation are input from the input section 36, the control section 35 controls the carriage drive mechanism 33 to move the recording heads 4, 4 . . . to the recording region Y. At this time, the control section 35 moves the light shielding unit 23 downward to remove the light shielding caps 24, 24 . . . from the recording heads 4, 4 . . . .

When the carriage 3 reached to a predetermined position in the recording region Y, the control section 35 drives the carriage 3 to reciprocatingly move the recording heads 4, 4 . . . in the main scanning direction A while moving the recording medium P in the sub scanning direction by the recording medium carrying mechanism 34. At this time, the control section 35 activates the recording heads 4, 4 . . . according to the input information and the predetermined image information from the input section 36, to thereby jet required colors of inks from the nozzles 5, 5 . . . . Further, the control section 35 controls the UV irradiation device 7, 7 . . . to irradiate the ink jetted on the recording medium P with ultraviolet rays, thereby curing and fixing the ink onto the recording medium P to form an image.

Next, the control section 35 controls the carriage drive mechanism 33 to move the recording heads 4, 4 . . . along the carriage rail 2 to the maintenance region Z.

When the recording heads 4, 4 . . . reached to a predetermined position, the control section 35 moves the maintenance unit 9 upward, thereby making each suction cap 10 on the maintenance unit 9 cover and seal each nozzle face 6 of the recording heads 4, 4 . . . . Thereafter, the control section 35 activates the suction pumps 12, 12 . . . to add negative pressure to the inside of the suction caps 10, 10 . . . , and suctions the ink in the nozzles 5, 5 . . . . When the ink suctioned from the nozzles 5, 5 . . . contacts an absorbing material (not shown) provided inside of each suction cap 10 to face the nozzle 5, the ink is absorbed into the absorbing material. The ink absorbed is fed through the ink communicating tube 11 to the waste ink tank 13 to be stored therein.

After the completion of the absorbing operation, the control section 35 moves the maintenance unit 9 downward once, thereby the suction caps 10, 10 . . . are separated from the nozzle faces 6, 6 . . . .

Thereafter, the control section 35 moves the carriage 3 to the position above the ink absorbing mechanism 14. When the recording heads 4, 4 . . . mounted on the carriage 3 reached to the position corresponding to the absorbing member 16 of the ink absorbing mechanism 14, the control section 35 moves the maintenance unit 9 upward to make the absorbing member 16 which is crossed over between the feed roller 17 and the winding roller 18 of the ink absorbing mechanism 14 contact with the nozzle faces 6, 6 . . . of the recording heads 4, 4 . . . . Thus, the ink adhered to the nozzle faces 6, 6 . . . is absorbed in the absorbing member 16. Then, the control section 35 activates the recording heads 4, 4 . . . to purge ink residue from the all nozzles 5, 5 . . . onto the absorbing member 16. After the completion of absorbing the ink on the nozzle faces 6, 6 . . . by the absorbing member 16 and the purging operation, the control section 35 moves the maintenance unit 9 downward to separate the recording heads 4, 4 . . . and the absorbing member 16 of the ink absorbing mechanism 14. When the recording heads 4, 4 . . . are sufficiently separated from the absorbing member 16, the control section 35 controls the roller drive mechanism 37 of the ink absorbing mechanism 14 to rotate the feed roller 17 and the winding roller 18, thereby feeding the absorbing member 16 from the feed roller 17 to sequentially carry the ink adhered portion in a direction where the winding roller 18 is arranged. At this time, the control section 35 controls the UV irradiation section 22 to make the UV light source 21 irradiate the absorbing member 16 with a small amount of ultraviolet rays, thereby the absorbing member 16 is wound by the winding roller 18 while the ink adhered to the absorbing member 16 being sequentially cured until the absorbing member 16 with no ink adhered thereto is positioned between the guide rollers 19*a* and 19*b*.

The maintenance operation of the recording heads 4, 4 . . . is then completed, and the inside of the nozzles 5, 5 . . . recovers a good condition for performing image recording again.

Next, the control section 35 moves the wipe unit 25 downward to the position where the absorbing member 27 which is crossed over between the feed roller 28 and the winding roller 29 of the wipe unit 25 contacts with the suction caps 10, 10 . . . . When the absorbing member 27 contacts with the suction caps 10, 10 . . . , the ink adhered to the suction caps 10, 10 . . . is absorbed into the absorbing member 27. After the completion of the ink absorbing and removing operations, the control section 35 moves the wipe unit 25 upward to separate the absorbing member 27 from the suction caps 10, 10 . . . , and controls the roller drive mechanism 38 of the wipe unit 25 to rotate the feed roller 28 and the winding roller 29, thereby feeding the absorbing member 27 from the feed roller 28 to sequentially carry the ink adhered portion in a direction where the winding roller 29 is arranged. At this time, the control section 35 controls the UV irradiation section 32 to make the UV light source 31 irradiate the absorbing member 27 with ultraviolet rays, therefore, the absorbing member 27 is wound by the winding roller 29 while the ink adhered to the absorbing member 27 being sequentially cured until the absorbing member 27 with no ink adhered thereto is positioned between the guide rollers 30*a* and 30*b*.

Accordingly, the ink adhered to the suction caps 10, 10 . . . is removed, enabling the suction caps 10, 10 . . . to contact with the nozzle faces of the recording heads and to recover an appropriate condition for performing ink suction operation.

Next, the control section 35 drives the carriage 3 to move it to the position above the platen 8. Then, the control section 35 moves the wipe unit 25 downward to the position where the absorbing member 27 of the wipe unit 25 contacts with the upper surface of the platen 8. Thereafter, the control section 35 moves the carriage 3 in the main scanning direction A to slide the absorbing member 27 on the platen 8, thereby absorbing and removing the ink adhered to the platen 8.

Accordingly, the platen 8 recovers an appropriate condition for image recording.

After the completion of absorbing and removing the ink adhered to the platen 8 by the wipe unit 25, the control section 35 moves the wipe unit 25 upward to separate the absorbing member 27 from the platen 8, and also rotates the feed roller 28 and the winding roller 29 by controlling the roller drive mechanism 38 of the wipe unit 25, thereby feeding the absorbing member 27 from the feed roller 28 to sequentially carry the ink adhered portion in a direction where the winding roller 29 is arranged. At this time, the control section 35 controls the UV irradiation section 32 to make the UV light source 31 irradiate the absorbing member 27 with ultraviolet rays, thereby the absorbing member 27 is wound by the winding roller 29 while the ink adhered to the absorbing member 27 being sequentially cured until the absorbing member 27 with no ink adhered thereto is positioned between the guide rollers 30*a* and 30*b*.

Accordingly, in this embodiment, since the absorbing member of the ink absorbing mechanism formed with high density fibers having extra fine thickness is used for wiping the nozzle faces 6, 6 . . . of the recording heads 4, 4 . . . , the ink adhered to the nozzle faces 6, 6 . . . can appropriately be absorbed and removed even in the case of using the ink with high viscosity for image recording.

Purging ink residue onto the absorbing member 16 is successful in saving space in the apparatus because an additional space for purging ink residue is not required. Further, since ink residue purged is absorbed into the absorbing member 16, and the portion of the absorbing member 16 on which the ink residue adhered is wound, a mechanism for suctioning ink is not required, enabling to simplify the configuration of the apparatus and reduce the cost for manufacturing the apparatuses.

In this embodiment, after purging ink residue onto the absorbing member 16, the ink is cured by irradiation with ultraviolet rays, so that there is less possibility that the ink may readhere to some other portions even while exchanging the absorbing member 16 or the like. Therefore, the maintenance of the ink absorbing mechanism 14 can easily be performed.

Further, in this embodiment, the absorbing member 27 of the wipe unit 25 formed with high density fibers having extra fine thickness is used for absorbing the ink adhered to the platen 8 and the suction caps 10, 10 . . . , so that the ink can appropriately be removed even in the case of using the ink with high viscosity for image recording. Therefore, the platen 8 is prevented from being damaged caused by the ink fixed thereon, enabling to carry the recording medium P smoothly. Also, deterioration of the contact between the suction caps 10, 10 . . . and the nozzle faces 6, 6 . . . of the recording heads 4, 4 . . . caused by the ink fixed onto the suction caps 10, 10 . . . can be prevented, enabling to normally perform the maintenance operation.

Further, in this embodiment, after absorbing the ink adhered to the platen 8 and the suction caps 10, 10 . . . by the absorbing member 27, the absorbing member 27 is irradiated with ultraviolet rays to cure the ink absorbed therein, so that there is less possibility that the ink may readhere to some other portion even while exchanging the absorbing member 27 or the like. Therefore, the maintenance of the wipe unit 25 per se can easily be performed.

In this embodiment, the wipe unit 25 is provided only on the side of the maintenance region Z of the carriage 3, however, the wipe unit 25 may be provided on both sides of the carriage 3. In this case, the wipe unit 25 on the side of the maintenance region Z removes the ink adhered to the platen 8 and the maintenance unit 9, and another wipe unit 25 on the side of the home position region X removes the ink adhered to the light shielding caps 24, 24 . . . of the light shielding unit 23.

Further, in this embodiment, the configuration is such that both of the ink absorbing mechanism 14 and the wipe unit 25 are provided, however, only one of them may be provided.

As the timing of winding the absorbing members 16 and 27 and ultraviolet ray irradiation, after the ink absorbing and removing operations by the ink absorbing mechanism 14 and the wipe unit 25, ultraviolet rays may be radiated while winding the absorbing members 16 and 27, or the absorbing members 16 and 27 may be wound after curing the ink by irradiation with ultraviolet rays.

The entire disclosure of Japanese Patent Application Nos. Tokugan 2003-120056 and Tokugan 2003-120067 which were filed on Apr. 24, 2003, including specification, claims, drawings and summary are incorporated herein by reference in its entirety.

What is claimed is:

1. An image recording apparatus comprising:

a recording head comprising a plurality of nozzles for jetting an ink; and a maintenance unit for performing a maintenance operation to the nozzles, the maintenance unit comprising an absorbing member to wipe an ink adhered to the nozzles and receive an ink residue purged from the nozzles during the maintenance operation, wherein each of the inks is a type of being cured by an irradiation with light, and the maintenance unit comprises a light irradiation device for irradiating the ink absorbed in the absorbing member with light.

2. The apparatus of claim 1, wherein the maintenance unit comprises a drive mechanism for moving an ink absorbed portion of the absorbing member to a new position after the absorbing member absorbed the ink.

3. The apparatus of claim 1, wherein the light irradiation device irradiates a small amount of light of 1 $mJ/cm^2$ to 30 $mJ/cm^2$.

4. The apparatus of claim 1, wherein the absorbing member is formed with a high density fiber having a fineness of 0.1 denier or less.

5. The apparatus of claim 1, wherein the ink has a viscosity of 10 to 500 mPa·s at 25° C. and a surface tension of 20 to 40 mN/m.

6. The apparatus of claim 1, wherein the ink comprises an active energy ray curable compound, and an active energy ray comprises an ultraviolet ray.

7. An image recording apparatus comprising:

a recording head comprising a plurality of nozzles for jetting an ink onto a recording medium;

a wipe unit provided on at least one of an upstream side and a downstream side of the recording head in a moving direction, the wipe unit comprising an absorbing member for absorbing an ink which was jetted and adhered to a portion other than the recording medium; and a platen for supporting the recording medium, wherein the absorbing member absorbs an ink adhered to the platen.

8. The apparatus of claim 7, wherein the wipe unit comprises a drive mechanism for moving an ink absorbed portion of the absorbing member to a new position after the absorbing member absorbed the ink.

9. The apparatus of claim 7, wherein the ink is a type of being cured by an irradiation with light, and the wipe unit comprises a light irradiation device for irradiating the ink absorbed in the absorbing member with light.

10. The apparatus of claim 7, wherein the absorbing member is formed with a high density fiber having a fineness of 0.1 denier or less.

11. The apparatus of claim 7, wherein the ink has a viscosity of 10 to 500 mPa·s at 25° C. and a surface tension of 20 to 40 mN/m.

12. The apparatus of claim 7, wherein the ink comprises an active energy ray curable compound, and an active energy ray comprises an ultraviolet ray.

13. The apparatus of claim 7, further comprising a suction cap in a movable range of the recording head for performing a maintenance of the nozzles by suctioning an ink in the nozzles of the recording head, wherein the absorbing member absorbs an ink adhered to the suction cap.

14. The apparatus of claim 13, wherein the wipe unit comprises a drive mechanism for moving an ink absorbed portion of the absorbing member to a new position after the absorbing member absorbed the ink.

15. The apparatus of claim 13, wherein each of the inks is a type of being cured by an irradiation with light, and the wipe unit comprises a light irradiation device for irradiating the ink absorbed in the absorbing member with light.

16. The apparatus of claim 13, wherein the absorbing member is formed with a high density fiber having a fineness of 0.1 denier or less.

17. The apparatus of claim 13, wherein the ink has a viscosity of 10 to 500 mPa·s at 25° C. and a surface tension of 20 to 40 mN/m.

18. The apparatus of claim 13, wherein the ink comprises an active energy ray curable compound, and an active energy ray comprises an ultraviolet ray.

19. An image recording apparatus comprising:

a recording head comprising a plurality of nozzles for jetting an ink onto a recording medium;

a wipe unit provided on at least one of an upstream side and a downstream side of the recording head in a moving direction, the wipe unit comprising an absorbing member for absorbing an ink which was jetted and adhered to a portion other than the recording medium;

a platen for supporting the recording medium, wherein the absorbing member absorbs an ink adhered to the platen; and a suction cap in a movable range of the recording head for performing a maintenance of the nozzles by suctioning an ink in the nozzles of the recording head, wherein the absorbing member absorbs an ink adhered to the suction cap;

wherein each of the inks is a type of being cured by an irradiation with light, and the wipe unit comprises a light irradiation device for irradiating the ink absorbed in the absorbing member with light.

* * * * *